US005618126A

United States Patent [19]

Watt

[11] Patent Number: 5,618,126

[45] Date of Patent: Apr. 8, 1997

[54] CONTROL MOUNTING FOR A HYPERBARIC CHAMBER

[76] Inventor: Richard W. Watt, 6064 Marylane Ct., Oconomowoc, Wis. 53066

[21] Appl. No.: 602,340

[22] Filed: Feb. 16, 1996

[51] Int. Cl.[6] ..... A61H 33/14

[52] U.S. Cl. ..... 403/24; 403/3; 294/68.1

[58] Field of Search ..... 403/3, 24; 128/202.12; 422/243; 294/68.3, 68.1; 248/345.1

[56] References Cited

U.S. PATENT DOCUMENTS

| | | | |
|---|---|---|---|
| 2,465,944 | 3/1949 | Taylor et al. | 294/68.1 X |
| 2,478,192 | 8/1949 | Harker | 294/68.3 X |
| 3,367,308 | 2/1968 | Quattrone et al. . | |
| 3,368,556 | 2/1968 | Jensen et al. . | |
| 3,877,427 | 4/1975 | Alexeev et al. . | |
| 4,195,949 | 4/1980 | Reiher . | |
| 4,227,524 | 10/1980 | Galerne . | |
| 4,236,513 | 12/1980 | LoPiano . | |
| 4,448,189 | 5/1984 | Lasley . | |
| 4,467,798 | 8/1984 | Saxon et al. . | |
| 4,633,859 | 1/1987 | Reneau . | |
| 4,811,729 | 3/1989 | Sands et al. . | |
| 4,893,615 | 1/1990 | Khabirova . | |
| 5,060,644 | 10/1991 | Loori . | |
| 5,123,767 | 6/1992 | Ishikura et al. | 403/24 |
| 5,327,904 | 7/1994 | Hannum . | |
| 5,402,775 | 4/1995 | Reneau . | |

*Primary Examiner*—Anthony Knight
*Attorney, Agent, or Firm*—Andrus, Sceales, Starke & Sawall

[57] ABSTRACT

A lifting and mounting apparatus that allows the control panel of a hyperbaric chamber to be removed. The lifting and control mounting apparatus has a pair of lifting lugs located near the axial end of the hyperbaric chamber. Each lifting lug consists of a vertically disposed lug plate having a lifting aperture. The mounting apparatus has a rectangular control housing which is sized to enclose the pair of lifting lugs when the control housing is in its operative position and attachment means securely connect the control housing to the lifting lugs positioned on the hyperbaric chamber. The attachment means allow the control panel to be demountably attached to the exterior of the hyperbaric chamber. A series of gas lines are attached to the control panel by a corresponding number of quick disconnect couplings. These quick disconnects allow the gas lines to be quickly and easily connected and disconnected from the hyperbaric chamber to the control panel. In this manner, the lifting and control mounting apparatus allows the control panel to be removed from the hyperbaric chamber for servicing and to provide access to a pair of integrally connected lifting lugs.

15 Claims, 4 Drawing Sheets

FIG. 3
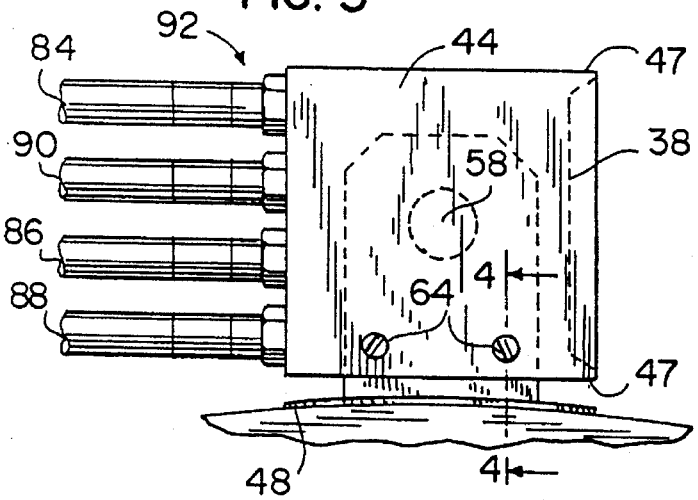
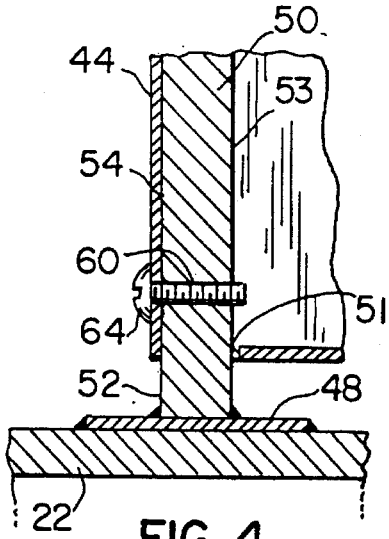
FIG. 4
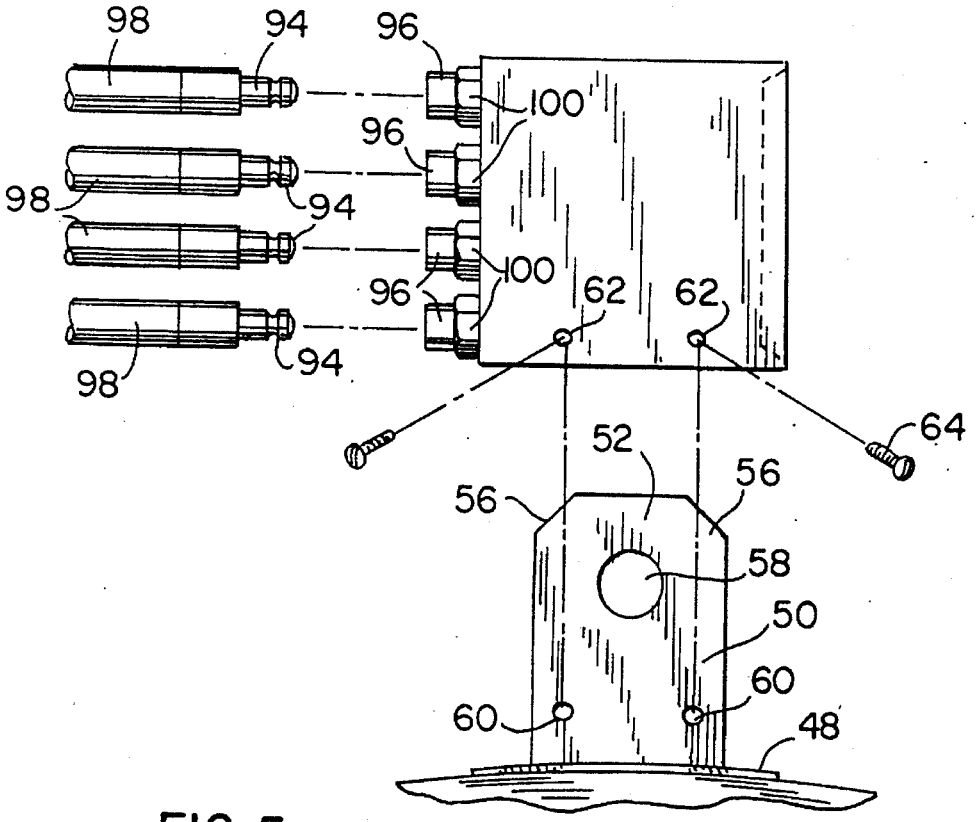
FIG. 5

FIG. 6
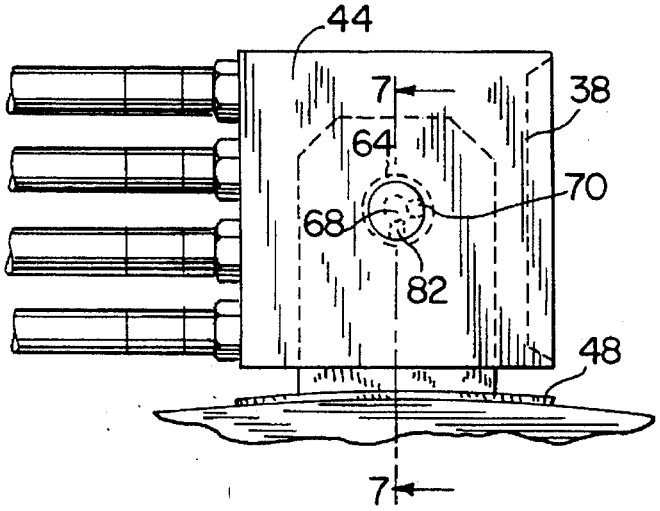
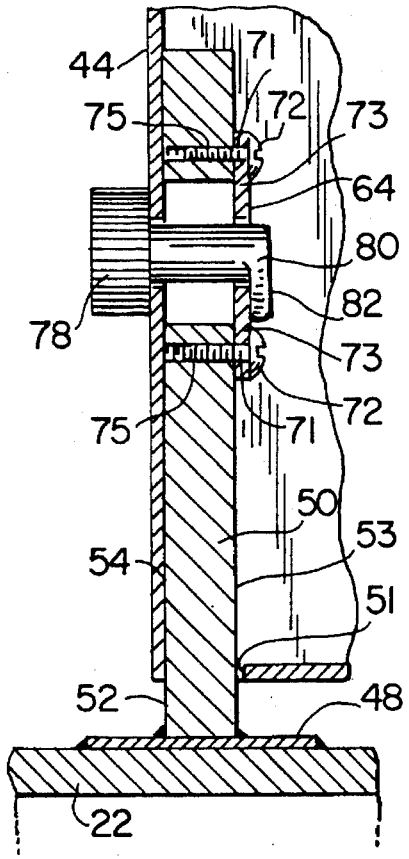
FIG. 7
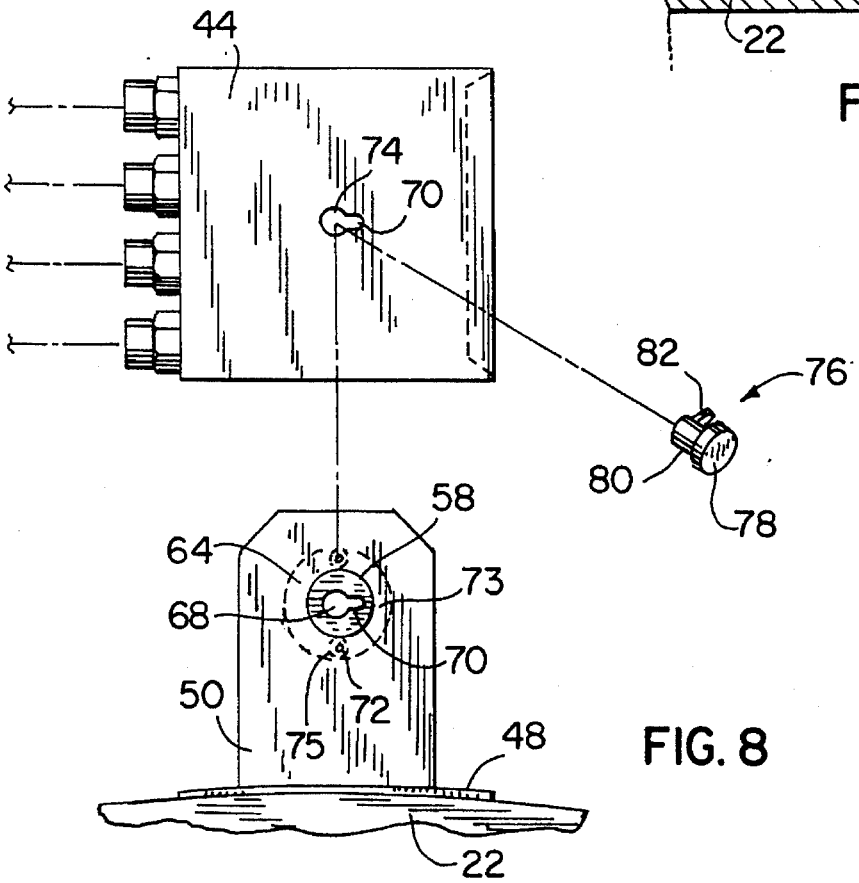
FIG. 8

CONTROL MOUNTING FOR A HYPERBARIC CHAMBER

FIELD OF THE INVENTION

This invention is generally related to a control system for a hyperbaric chamber and is specifically directed to a lifting and mounting apparatus for a modular flow control system for a hyperbaric oxygen chamber receiving oxygen gas from a pressurized source and venting a mixture of oxygen and other gas to atmosphere.

BACKGROUND OF THE INVENTION

Hyperbaric oxygen therapy (HBO) is a clinically proven technology that has been safely used since the turn of the twentieth century and has become an established treatment procedure for a wide range of human ailments. The following disorders have been shown to respond to hyperbaric oxygen therapy: air or gas embolism, burns, frostbite, carbon monoxide, acute smoke inhalation, crush injury, compartmental syndrome, cyanide poisoning, extensive blood loss, gas gangrene, compromised skin grafts or flaps, and healing wounds.

Hyperbaric oxygen therapy is a medical treatment in which the patient is entirely enclosed in a pressure chamber breathing 100% oxygen at a pressure greater than 1 atmosphere. Breathing 100% oxygen at 1 atmosphere is not considered hyperbaric oxygenation, nor is topical application of oxygen outside a pressurized chamber.

HBO physically dissolves extra oxygen into the blood plasma and tissues. Breathing pure oxygen at 2.5 times normal pressure (2.5 ATA) causes a twelve-fold increase in dissolved oxygen in the plasma compared with breathing at atmospheric pressure. Increased oxygen pressure has been demonstrated to induce formation of new capillaries in ischemic or poorly perfused wounds. Hyperoxygenation is useful in the treatment of ischemic tissue as well as compromised chronic wounds, flaps, and grafts. It is also useful in specific infections.

High pressure oxygen causes constriction of the blood vessels in normal tissue without creating hypoxia. However, it does not cause constriction in previously oxygen-deprived tissue. HBO is useful in crush injury and other traumatic ischemic injuries, since it clearly reduces the adherence of white cells to capillary walls, consequently relieving the "no reflow" condition. Reducing of edema is a major benefit of HBO as a result of its preservation of high energy phosphate bonds in the cells. It is also important in preventing progression of deep second degree burns to full thickness injury requiring grafting.

Most of the bodies bacterial defense mechanisms are oxygen dependent. HBO is particularly effective in patients where resistance factors have been compromised, such as dysvascular conditions and immunosuppression disorders. HBO therapy inhibits the growth of a number of anaerobic organisms and enhances the white cell killing of aerobic organisms. The effect of HBO on white cells can double or triple their bacteria-killing ability.

Although the use of HBO therapy has been used for the above-noted human ailments, a new and effective use of HBO has recently been found for treating various illnesses effecting household pets, such as dogs, cats, birds, and other small animals. Since household pets are smaller than their human counterparts, the hyperbaric oxygen chamber which is used to treat the animals can be smaller and more compact.

Additionally, since many different species of animals can benefit from the use of the hyperbaric oxygen chamber, the conditions within the chamber must be varied according to the species of animal contained within.

Most current hyperbaric oxygen chambers contain a control system which monitors the pressure of oxygen being supplied to the chamber and controls the amount of gas exiting the chamber. The control systems used in many of hyperbaric oxygen chambers contain a complex series of measuring and control devices to monitor several pressures associated with the hyperbaric chamber. Although these control systems adequately control the pressure within the chamber and the rate of flow of oxygen into and out of the chamber, these systems are often overly complicated and do not provide an efficient method of protecting the chamber occupant upon a clinical emergency.

In many hyperbaric oxygen chambers, the control system for controlling the oxygen flow and pressure within the chamber is permanently fixed to the outer surface of the hyperbaric chamber. If the control system needs to be adjusted or repaired, a service technician must work on the control system as it is mounted to the hyperbaric chamber, since the physical size of the hyperbaric chamber makes moving the entire chamber to the manufacturer or service department impractical for repairs.

Therefore, it can be appreciated that a hyperbaric oxygen chamber having a control system which is securely mounted to the hyperbaric chamber while at the same time being easily removable for service would be desirable.

SUMMARY OF THE INVENTION

The invention is related to a lifting and control mounting apparatus that allows the control panel to be removed from the hyperbaric chamber for servicing or to provide access to a pair of integrally connected lifting lugs.

The hyperbaric chamber to which the invention is applied includes a pair of lifting lugs spaced near its axial ends. The lifting lugs are securely fixed to the top of the hyperbaric chamber surface, such that they provide a point of attachment for a lifting mechanism. The lifting lugs of the hyperbaric chamber are used during the manufacture of the chamber and subsequently thereafter to move the chamber as required.

The lifting and control mounting apparatus further has a control panel which is used to control the flow of oxygen and vented gas into and out of the pressure chamber. The control panel consists of an outer control housing into which the control hardware, such as various gauges and valves, is mounted.

The control panel housing is generally a rectangular enclosure which is sized to span and enclose the lifting lugs. When the control panel housing is placed in its operative position, the end walls of the control housing enclose the lugs within the housing interior.

Once the control panel is in its operative position, two embodiments for attaching the housing to the hyperbaric chamber are disclosed. In the first embodiment, a pair of screws are inserted through the exterior of the housing and are received in a pair of mounting apertures contained in the lifting lug plate. In the second embodiment of the invention, a key bolt is inserted through a keyed opening in the end wall of the housing. The key bolt passes through both the end wall and a second keyed opening in a washer mounted to the inner face of the lifting lug plate. Once in position, the key bolt is rotated such that a prong contained on the bolt interacts with the washer to securely attach the control housing to the hyperbaric chamber.

The lifting lugs attached to the exterior of the pressure chamber are generally rectangular in shape and have opposite flat end faces which are connected by a narrow side wall. The lifting lugs each contain a lifting aperture centered about a horizontal axis.

A series of gas lines are connected to the back wall of the control housing to provide communication between the control panel and the hyperbaric chamber. Each of the gas lines is connected to the control housing by a quick disconnect coupling. The quick disconnect coupling consists of a matching male and female connecting portions. The male connecting portion is contained on the end of each hose of the individual gas lines, while the female portion is securely connected to the back wall of the control housing. The quick disconnects allow the gas lines to be securely and quickly connected and disconnected from the control housing.

The lifting and control mounting apparatus allows the user of the hyperbaric chamber to remove the control panel quickly and easily as is desired. For instance, if the owner of the hyperbaric chamber wishes to have the control panel serviced or the internal settings adjusted, the owner can simply remove the quick disconnect couplings and the attachment means between the control housing and the lifting lugs and simply remove the entire control panel. The control panel can then be shipped to the desired location for servicing and/or adjustment of the control panel.

BRIEF DESCRIPTION OF THE DRAWINGS

The drawings illustrate the best mode presently contemplated of carrying out the invention.

In the drawings:

FIG. 3 is a side plan view of the first embodiment of the lifting and control mounting apparatus;

FIG. 4 is a sectional view taken along line 4—4 of FIG. 3;

FIG. 5 is an exploded side view of the mounting and control mounting apparatus showing the quick disconnect couplings;

FIG. 6 is a side plan view of the second embodiment of the lifting and control mounting apparatus;

FIG. 7 is a sectional view taken along line 7—7 of FIG. 6;

FIG. 8 is an exploded side view of the second embodiment of the lifting and control mounting apparatus;

Figure 1:
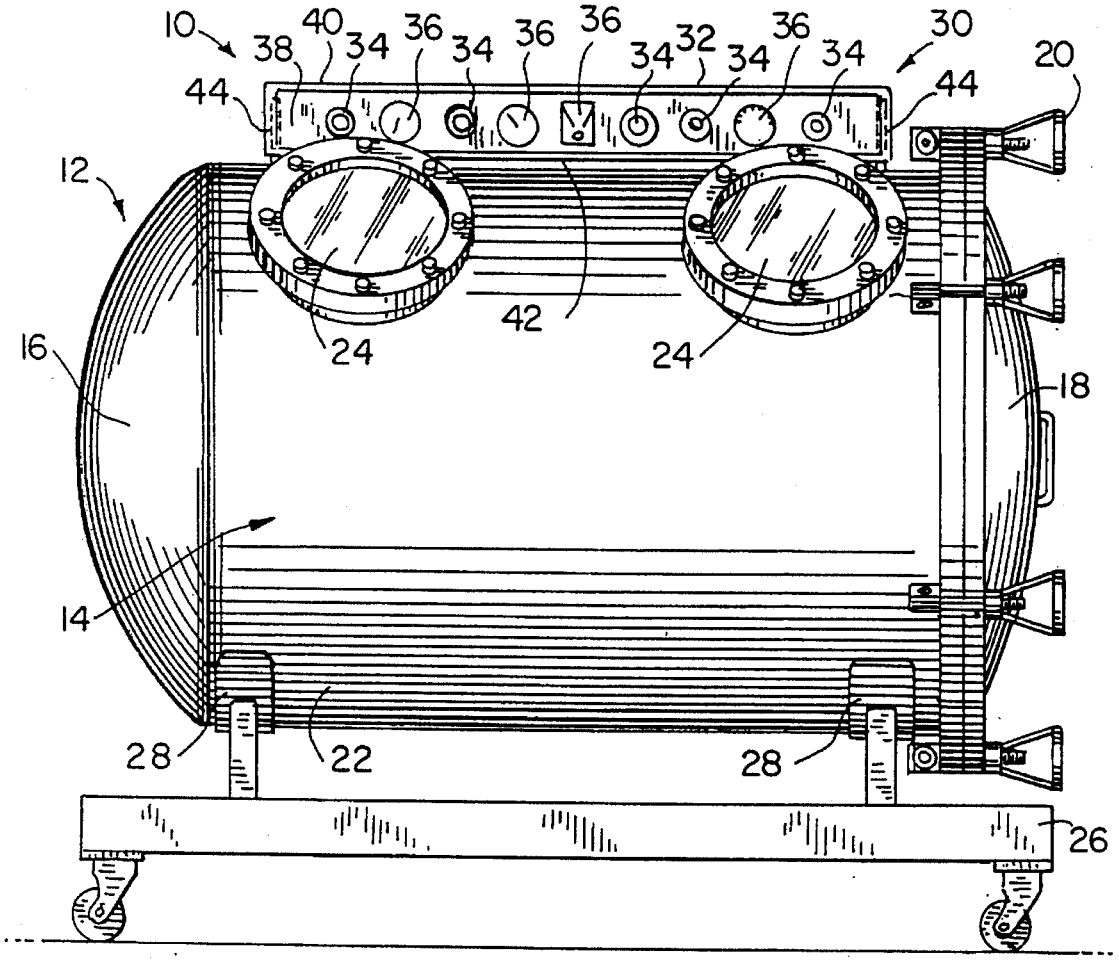
FIG. 1 is a front plan view of the lifting and control mounting apparatus as mounted to a cylindrical pressure chamber.

Referring to the drawings, the invention is a lifting and control mounting apparatus 10 for a cylindrical pressure chamber (or hyperbaric chamber), generally designated by the reference numeral 12.

The hyperbaric chamber 12 is a cylindrical pressure chamber adapted to receive oxygen at a pressure greater than one atmosphere. The hyperbaric chamber 12 consists of a body 14, a fixed pressure head 16, and a movable door 18. The door 18 is moveable from an open position (not shown) to a closed position, as shown in FIG. 1. In the closed position, a plurality of hand wheel closures 20 are used to provide an air-tight seal between the inner circumferential surface of door 18 and the end of the body 14.

The body 14 is comprised of a continuous outer wall 22 which defines an open interior portion, not shown. The combination of the outer wall 22, the fixed pressure head 16 and the door 18 form an airtight open interior into which the patient can be placed for treatment. As can be seen in FIG. 1, in its operative position the cylindrical axis of the chamber 12 is horizontally disposed. In the preferred embodiment, the door 18 therefore pivots about a vertical axis between its open and closed positions.

A pair of viewing windows 24 are contained in the outer wall 22 which provide an air-tight viewing port into the interior of the hyperbaric chamber 12. These windows 24 allow the physician or veterinarian administering the treatment to monitor the subject contained within the open interior portion of the hyperbaric chamber 12.

The hyperbaric chamber 12 is preferably mounted to a movable cart 26 through a pair of cradles 28. The movable cart 26 allows the physician or veterinarian to position the hyperbaric chamber 12 as desired.

The amount of oxygen and the pressure within the hyperbaric chamber 12 are controlled by a control panel 30. The control panel 30 consists of an outer control housing 32 that surrounds a series of valves 34 and gauges 36 that monitor and control the pressure and flow of oxygen into and out of the chamber 12.

The control housing 32 is generally comprised of a rectangular front face surface 38, a top wall 40, a bottom wall 42, a pair of opposite end walls 44, and a back wall 45. In the preferred embodiment of the invention, the housing 32 is constructed of 16-gauge stainless steel. The combination of the face plate 38, the top wall 40, the bottom wall 42, the pair of end walls 44, and the back wall 45 combine to create a control housing 32 which is generally rectangular in shape, as can best be seen in FIGS. 1 and 3. The face plate 38 is slightly recessed from the forward edge 47 of both the top wall 40 and bottom wall 42. As shown in FIG. 1, the valves 34 and gauges 36 are mounted to the face plate 38 so they are clearly visible when the control panel 30 is mounted to the hyperbaric chamber 12.

Figure 2:
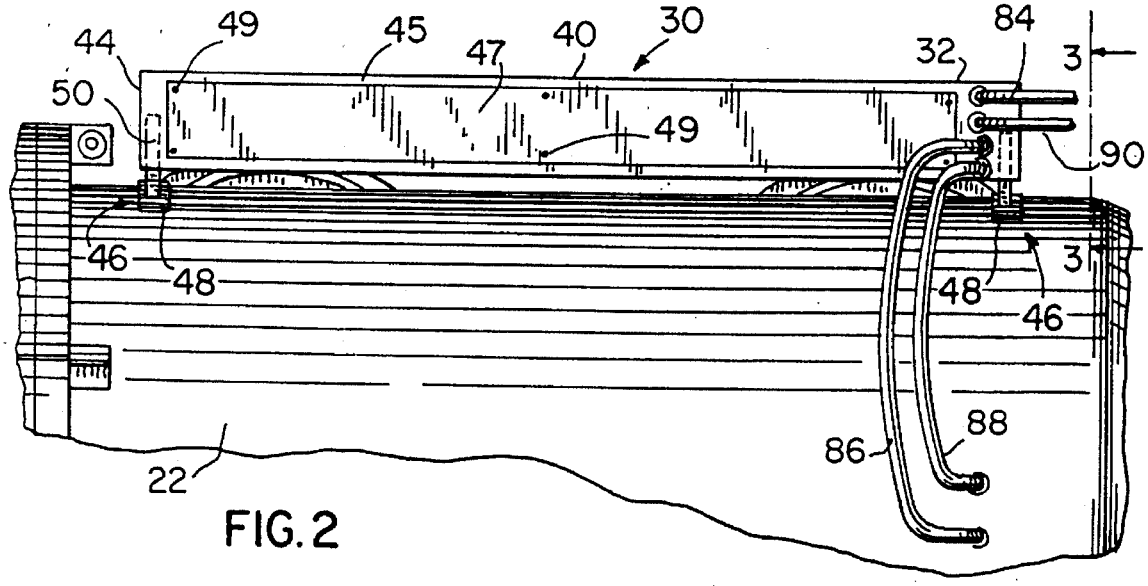
FIG. 2 is a partial back plan view of the lifting and control mounting apparatus as mounted to a cylindrical pressure chamber.

As can best be seen in FIG. 2, a pair of lifting lugs 46 are securely connected to the outer wall 22 of the hyperbaric chamber 12. The lifting lugs 46 are preferably located at opposite axial ends of the hyperbaric chamber 12 and are generally centered about a vertical axis extending through the center of the chamber 12. The lifting lugs 46 generally consist of a lower cradle 48 and a securely connected lug plate 50. In the preferred embodiment of the invention, the cradle portion 48 of each lifting lug 46 is fixed to the outer wall 22 of the hyperbaric chamber by welding (FIGS. 4 and 7).

Referring now to FIG. 2, the control housing 32 is thereshown in its operative position. The control housing 32 is sized such that the pair of lifting lugs 46 are both contained within the enclosure defined by the housing 32. In particular, the lug plates 50 are located slightly inward from the pair of end walls 44. In this manner, the pair of lifting lugs 46 are effectively concealed when the control panel 30 is in its operative position.

The back wall 45 of the control housing 32 preferably includes a removable access panel 47. The access panel 47 is securely connected to the back wall 45 by a series of screws 49. By removing the access panel 47, the user can expose the internal connections of the gauges 36 and valves 34 for servicing or adjustment.

Each of the lifting lug plates 50 is a vertically disposed generally rectangular structure having a pair of angled top corners 56. The lifting lug plate 50 is comprised of an outer face 52 and an inner face 53 spaced apart by the thickness of the lug plate 50. The lug plate 50 further includes a pair of attachment means. The first attachment means is a circular lifting aperture 58 centered about a horizontal axis. The lifting aperture 58 is centered about the horizontal midpoint of the lug plate 50 and located slightly above the vertical midpoint of the lug plate 50. The second attachment means are a pair of mounting apertures 60.

FIGS. 3–5 show the first embodiment of the connection between the control housing 32 and the lifting lugs 46. Each of the lug plates 50 extends upwardly through a slot 51 contained on opposite ends of the bottom wall 42 of the control housing 32, such that the outer face 52 of each lug plate is located adjacent to the inner surface 54 of each end wall 44. The overall height of the lifting lugs 46 is less than the height of the end wall 44, such that the control housing 32 completely contains the lug plate 50.

As can be seen in FIG. 5, the end wall 44 has a pair of attachment apertures 62 passing therethrough which are spaced to correspond to the pair of mounting apertures 60 contained on the lug plate 50. When the control housing 32 is placed in its operative position, the attachment apertures 62 are in axial alignment with the mounting apertures 60. A pair of fasteners 64, such as screws, are placed through the attachment apertures 62 contained in the end wall 44 and are received in the mounting apertures 60 contained in the lifting lug plates 50. In the preferred embodiment of the invention, the mounting apertures 60 are threaded bores in the lifting lug plates 50. In this manner, the control housing 32 is securely but demountable attached to the lifting lug 46.

Referring now to FIGS. 6–8, a second embodiment of the attachment between the lifting lugs 46 and the control housing 32 is thereshown. As in the previous embodiment, the outer face 52 of each lug plate 50 is positioned adjacent the inner surface 54 of the end walls 44 when the control housing 32 is in its operative position. As in the first embodiment, the lug plate 50 contains a first attachment means which consists of a cylindrical lifting aperture 58 centered about a horizontal axis. Unlike the first embodiment, however, the second embodiment does not contain a pair of mounting apertures 60. Instead, a washer 64 is securely connected to the inner face 53 of the lug plate 50. The washer 64 has a keyed opening 68 centered about the horizontal axis of the lifting aperture 58. The keyed opening 68 is generally a circular opening having a notch 70 extending horizontally from its circumference. The keyed opening 68, including the notch 70, are smaller in diameter than the lifting aperture 58.

As shown in FIG. 7, the washer 64 has an outer diameter greater than the diameter of the lifting aperture 58. The washer 64 is securely connected to the inner face 53 of the lug plate 50 by a pair of attachment screws 72. The attachment screws 72 pass through a pair of openings 71 contained in the overlapping portion 73 of the washer 64 extending past the outer diameter of the lifting aperture 58. The attachment screws 72 are received in a pair of aligned threaded bores 75 contained in the lug plate 50. Although attachment screws 72 are shown, any method of securely attaching the washer 64 to the inner face 53 would be adequate.

A matching keyed opening 74 is also included in the end wall 44 of the control housing 32. Once the control housing 32 is placed in its operative position, a key bolt 76 is used to securely attach the control housing 32 to the pair of lifting lugs 46. The key bolt 76 is comprised of a head 78, a shaft 80 and a prong 82. With the housing 32 is in its operative position, the key bolt 76 is inserted through the keyed openings 68 and 74 contained in the end wall 44 and the lug plate 50. In doing so, the prong 82 passes through the matching notches 70 contained in both keyed openings 68 and 74 until the head 78 contacts the outer surface of the end wall 44. The head 78 is then rotated such that the prong 82 is no longer aligned with the horizontally disposed notch 70 in the keyed opening 68 of the washer 64. In this manner, the prong 82 acts to securely hold the key bolt 76 in place. To remove the key bolt 76, the head 78 is rotated until the prong 82 again is in alignment with the notches 70 contained within each of the keyed openings 68 and 74. In this manner, the control housing 32 can be quickly and securely attached to the lifting lug 46.

Figure 9:
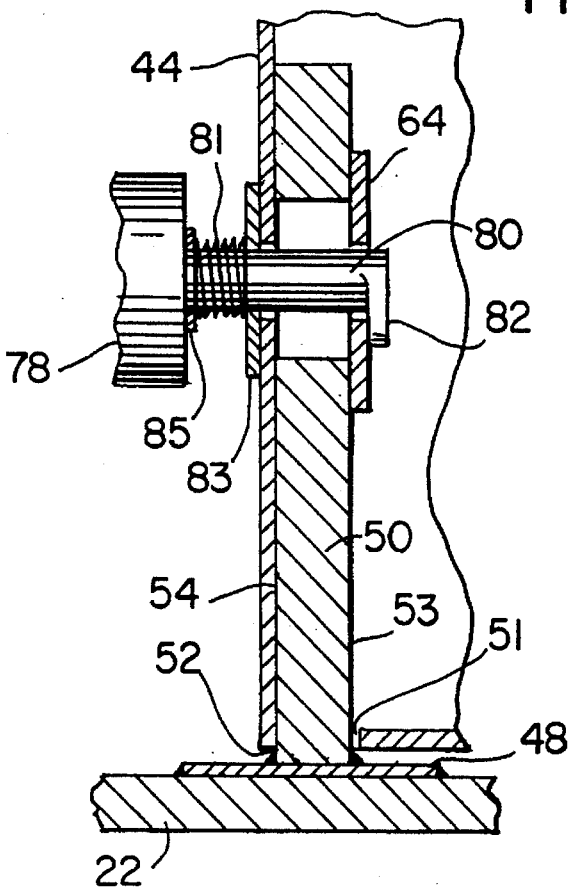
FIG. 9 is a sectional view showing an alternate arrangement of the second embodiment of the lifting and control mounting apparatus.
Figure 10:
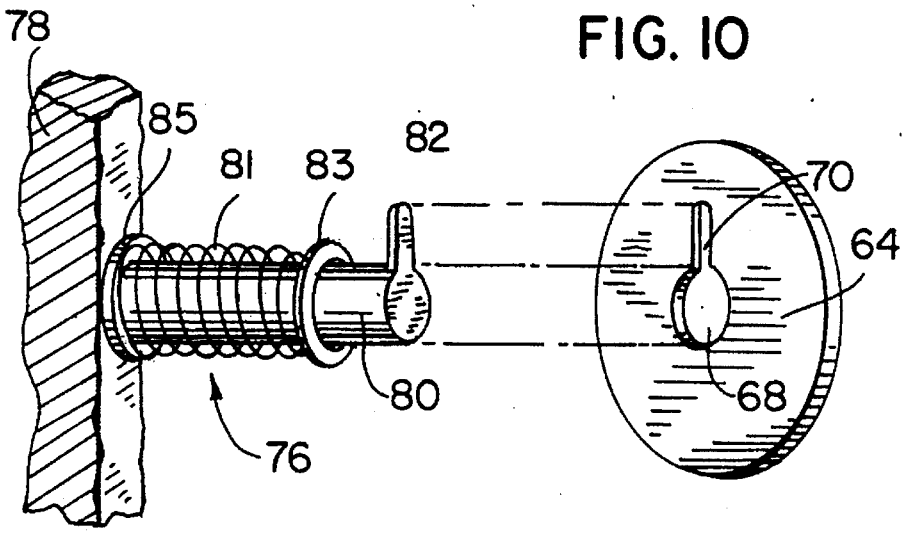
FIG. 10 is a perspective view of the alternate arrangement of FIG. 9.

Referring now to FIGS. 9 and 10, an alternate arrangement of the second embodiment of the attachment between the lifting lugs 46 and the control housing 32 is thereshown and corresponding reference numerals have been used to facilitate clarity. As in the second embodiment of the attachment shown in FIGS. 6–8, a washer 64 having a keyed opening 68 with a notch 70 is also used. Unlike the second embodiment, however, the washer 64 is not securely attached to the lug plate 50 by a pair of attachment screws 72. Rather, a bias spring arrangement is used to securely position the washer 64 on the inner face 53 of the lug plate 50.

Referring now to FIG. 9, a bias spring 81 is positioned between a washer 83 contained on the shaft 80 and a second washer 85 positioned near the inner surface of the head 78 of the key bolt 76. As in the second embodiment previously disclosed, the prong 82 is received in the notch 70 of the washer 64 and subsequently rotated until the prong 82 engages the inner surface of the washer 64. In the alternate arrangement, the spring 81 acts to exert a bias force between the prong 82 and the inner surface of the washer 64 to securely position the washer 64 as indicated. The spring 81 of the alternate arrangement acts not only to hold the washer 64 in place, but also compensates for any variation in the dimension of the lug plate 50, control panel housing 32 or washer 64.

Referring again to FIG. 2, the individual gas connections to the control panel 30 are shown. Shown are an oxygen supply line 84, an oxygen supply to the chamber 86, a vent gas connection 88 from the chamber to the control panel, and a vent gas connection 90 to atmosphere. Each of these connections are to the back wall 45 of the control housing 32 when the housing 32 is in its operative position.

Referring now to FIGS. 3 and 5, the gas connections are shown in more detail. Each of the gas lines 84–90 is connected to the control housing 32 by a quick disconnect coupling 92, which are well known in the prior art. Each quick disconnect coupling 92 consists of a male connector 94 contained on the end of each air hose 98, which is received by a matching female connecting portion 96, securely connected to the back wall 45 of the control housing 32. The quick disconnect couplings 92 permit each of the hoses 98 to be quickly and easily connected to the back of the control housing 32. The female portion 96 of each quick disconnect 92 is secured to the back of the control housing 32 by a nut 100. In operation, the male connection 94 is inserted into the female connection 96 and force is applied to quickly make the connection. In this manner, the supply hoses 98 can be quickly and easily connected to the control housing 32.

When the hyperbaric chamber is initially constructed, a pair of lifting lugs 46 are securely attached to the top of the outer wall 22. Once attached, a lifting mechanism, not shown, such as a crane hook may be connected to the lifting aperture 58 contained within the lug plate 50. With the lifting mechanism attached, the hyperbaric chamber 12 can be lifted and moved when it is not readily movable on the wheeled cart 26, as needed. Once the hyperbaric chamber 12 is located near its place of use, the control panel 30 can then be attached.

In the second embodiment of the invention, before the control panel 30 is attached, the washer 64 must be securely attached to the inner face 53 of the lifting lug 50. Once the washer 64 is attached to the lug plate 50, the control housing 32 is placed over the lifting lugs 46. To do this, each of the lug plates 50 are inserted through the pair of open notches 51 contained on opposite ends of the bottom wall 42 of the control housing 32. The control housing 32 is then lowered into position, as shown in FIGS. 3 and 6.

Once in position, the attachment method of either the first or second embodiment is employed. In the first embodiment, a pair of screws 63 are inserted through the attachment apertures 62 contained in the end wall 44 and are received within the threaded mounting apertures 60 contained in the lug plates 50. In the second embodiment of the invention, once the control housing 32 is in the operative position, the key bolt 76 is inserted into the keyed opening 74 in the end wall 44. The key bolt 76 then passes through the keyed opening 68 contained in the washer 64 until the prong 82 extends past the washer 64. Once this occurs, the head 78 of the key bolt 76 is rotated until the prong 82 is no longer aligned with the notch 70 of the washer 64. Therefore, in the second embodiment of the invention, the lifting aperture 58 acts as both the attachment means for a lifting device and as the attachment means for the control panel 30.

The lifting and control mounting apparatus of the invention allows the control panel 30 to be securely connected to the fixed lifting lugs 46, while at the same time concealing the lifting lugs 46 when they are not needed. Once the control panel 30 is in place, the plurality of gas lines 84–90 are connected. In this manner, the control panel can be quickly and easily mounted to the hyperbaric chamber 12.

Subsequently, if a problem should arise with the control panel 30, or if the hyperbaric chamber 12 needs to be moved further than the cart 26 allows, the control panel 30 can be removed from the hyperbaric chamber 12 to expose the lifting lugs 46. This is done as follows. First, the quick disconnect couplings 92 contained on each of the gas lines 84–90 are removed from the control housing 32. Next, the attachment means between the end wall 44 and the lug plate 50 are removed. In the first embodiment of the invention, this comprises removing the pair of attachment screws 64. In the second embodiment of the invention, this comprises rotating the head of the key bolt 76 until the prong 82 is in alignment with the notch 70 contained in the pair of keyed openings 68 and 74. The key bolt 76 can then be removed from the washer 64 and end wall 44. With the attachment means removed, the control panel 30 can then be lifted up and away from the lifting lugs 46 and subsequently serviced.

In the second embodiment of the invention, if the hyperbaric chamber needs to be moved, an additional step must be performed. This step consists of removing the washer 64 from the inner face 53 of the lug plate 50. If it were not removed, the washer 64 could be damaged upon inserting a lifting mechanism within the lifting aperture 58. Once the washer 64 is removed, the lifting mechanism can be inserted into the lifting aperture 58 and the chamber moved as desired.

As previously described, the lifting and control mounting apparatus provides a secure and stable connection between the control panel 30 and the exterior surface of the hyperbaric chamber 12. Additionally, when the control panel 30 is in its operative position, the lifting lugs 46 are completely contained within the interior of the control housing 32 such that the lifting lugs 46 are no longer visible to the user. By mounting the control panel 30 as such, the entire control arrangement can be quickly and easily removed from the exterior of the hyperbaric chamber 12 as desired.

It is thought that the present invention and its advantages will be understood from the foregoing description and it will be apparent that various changes may be made thereto without departing from the spirit and scope of the invention and sacrificing all of its material advantages. The form hereinbefore described being merely a preferred or explanatory embodiment thereof.

I claim:

1. A lifting and control mounting apparatus for a cylindrical pressure chamber adapted in use to be positioned with its cylindrical axis horizontally disposed, said apparatus comprising:

a pair of spaced lifting lugs fixed to the top of the cylindrical surface of the chamber near the opposite axial ends thereof;

a control panel including a control housing sized to span and enclose the lugs when said control housing is in its operative position;

said lugs including first attachment means for attachment of a chamber lifting device and second attachment means for attachment of said control panel; and demountable connectors operatively connected to said second attachment means to secure the control housing in its operative position and to permit removal of said housing for access to said first attachment means.

2. The apparatus of claim 1 wherein said first attachment means comprises a lifting aperture in each of said lugs centered about an axis parallel to the axis of the chamber.

3. The apparatus as set forth in claim 1 wherein each of said lugs are comprised of a generally rectangularly shaped plate disposed generally perpendicular to the chamber axis and each having opposite flat end faces, and said control housing includes a pair of opposite end slots for receipt of said lugs.

4. The apparatus as set forth in claim 3 wherein said control housing comprises a rectangular enclosure including opposite end walls disposed to lie closely adjacent the outside end faces of said lugs.

5. The apparatus as set forth in claim 4 wherein said second attachment means comprises a first portion of said demountable connector, and further including a second portion of said demountable connector adapted to cooperate with said first portion to interconnect each housing end wall to its adjacent lug face.

6. A lifting and control mounting apparatus for a cylindrical pressure chamber adapted in use to be positioned with its cylindrical axis horizontally disposed, said apparatus comprising:

a pair of spaced lifting lugs fixed to the top of the cylindrical surface of the chamber;

a control panel including a control housing sized to span and enclose the lugs when said control housing is in its operative position;

said lugs including an attachment means for attachment of a chamber lifting device and attachment of said control panel; and demountable connectors operatively connected to said attachment means to secure said control housing in its operative position and permit removal of said control housing.

7. The apparatus as set forth in claim 6, wherein said attachment means comprises aligned lifting apertures in said lugs centered about an axis parallel to the axis of the chamber.

8. The apparatus as set forth in claim 7 and further comprising a washer demountably fixed to each of said lugs and centered about the axis of said lifting aperture in said lugs.

9. The apparatus as set forth in claim 6 wherein said lugs comprise generally rectangular shaped plates disposed generally perpendicular to the chamber axis and each having opposite flat end faces, and said control housing including a pair of opposite end slots for receipt of said lugs.

10. The apparatus as set forth in claim 6 wherein said housing includes opposite end walls disposed to lie closely adjacent to the outside end face of said lugs.

11. A modular control mounting arrangement for a cylindrical pressure chamber adapted in use to be positioned with its cylindrical axis horizontally disposed, said arrangement comprising:

a pair of generally rectangular spaced lifting lugs fixed to the top of the cylindrical surface of the chamber near the opposite axial ends thereof, said lugs each having opposite flat end faces;

a control panel including a control housing sized to span and enclose the lugs when said housing is in it operative position, said control housing having opposite end walls disposed to lie closely adjacent to the outside end faces of said lugs;

attachment means included in said lifting lugs, said attachment means receiving a demountable connector passing through the end walls of said control housing and received within said attachment means for demountably connecting said control housing to said lifting lugs.

12. The control mounting arrangement of claim 11, wherein said lifting lugs are vertically disposed and received in a pair of opposite end slots contained in the bottom wall of said control housing when said housing is in its operative position.

13. The control mounting arrangement of claim 11, wherein said attachment means comprise a lifting aperture contained in each lifting lug and centered about an axis parallel to the axis of the chamber.

14. The control mounting arrangement of claim 13, further comprising a washer demountably fixed to the flat end face of each lifting lug, said washer centered about the axis of said lifting aperture.

15. The control mounting arrangement of claim 14, wherein said demountable connector is a bolt having a head, a shaft and a prong, said head engaging the end wall of said control housing and said prong engaging said washer to securely attach said housing to said lifting lugs.

* * * * *